US008141269B2

(12) United States Patent
Seiffert et al.

(10) Patent No.: US 8,141,269 B2
(45) Date of Patent: Mar. 27, 2012

(54) EXPANDABLE/COLLAPSIBLE ENCLOSURE FOR A CLOTHES REFRESHER

(75) Inventors: George F. Seiffert, Stevensville, MI (US); Timothy J. Hicks, Berrien Springs, MI (US); Shawn Oltz, Niles, MI (US); Wesley Traylor, St. Joseph, MI (US); Floyd Jackson, Baroda, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1423 days.

(21) Appl. No.: 10/852,758

(22) Filed: May 24, 2004

(65) Prior Publication Data

US 2005/0257440 A1 Nov. 24, 2005

(51) Int. Cl.

| | |
|---|---|
| ***F26B 19/00*** | (2006.01) |
| ***F26B 25/08*** | (2006.01) |
| ***A41H 43/00*** | (2006.01) |

(52) U.S. Cl. ..... 34/202; 34/218; 223/51

(58) Field of Classification Search ..... 220/666, 220/9.2, 9.4, 610, 615, 617, 621; 223/51; 34/622, 621, 202, 218; 16/87.2, 227; D32/5, D32/8, 12, 25, 58; 68/5 C, 6; 206/287, 289, 206/287.1

See application file for complete search history.

(56) References Cited

U.S. PATENT DOCUMENTS

| | | | | |
|---|---|---|---|---|
| 2,701,921 | A * | 2/1955 | Strongson | 34/622 |
| 3,432,939 | A * | 3/1969 | Eichholz | 34/622 |
| 3,612,590 | A * | 10/1971 | Andreini et al. | 292/76 |
| 3,670,425 | A * | 6/1972 | Benjamin et al. | 34/542 |
| 3,835,552 | A * | 9/1974 | Lord | 34/621 |
| 3,905,125 | A | 9/1975 | Hubner | |
| 4,833,756 | A * | 5/1989 | Terlecke et al. | 16/87.2 |
| 5,730,006 | A * | 3/1998 | Conley | 68/6 |
| 6,457,257 | B1 * | 10/2002 | Hughes | 34/218 |
| 6,801,140 | B2 * | 10/2004 | Mantyjarvi et al. | 340/999 |
| 6,840,068 | B2 * | 1/2005 | Pasin et al. | 68/5 C |

FOREIGN PATENT DOCUMENTS

| | | |
|---|---|---|
| DE | 9205567 U1 | 7/1992 |
| EP | 1057923 A1 | 12/2000 |
| EP | 1182292 A1 | 2/2002 |
| EP | 1215330 A1 | 6/2002 |

* cited by examiner

*Primary Examiner* — Bryon Gehman
*Assistant Examiner* — Shawn Braden
(74) *Attorney, Agent, or Firm* — Clifton G. Green; Greer, Burns & Crain, Ltd

(57) ABSTRACT

An expandable and collapsible enclosure is provided for a garment refreshing appliance. The appliance has at least either a top or a bottom rigid housing structure. The enclosure comprises a wall structure extending substantially an entire height of the enclosure. The wall structure is made of a flexible material. An opening is provided in the wall structure through which garments can be introduced into or removed from the enclosure. A zipper is attached at the opening to selectively open and close the opening. A snap attachment mechanism is located at either or both of the top and a bottom of the wall structure for securing the wall structure to the top and/or bottom rigid housing structures.

21 Claims, 4 Drawing Sheets

EXPANDABLE/COLLAPSIBLE ENCLOSURE FOR A CLOTHES REFRESHER

BACKGROUND OF THE INVENTION

The present invention relates to garment treating apparatus and more particularly to an enclosure for an apparatus used for cleaning, deodorizing and de-wrinkling garments in the presence of an air flow.

The prior art provides various devices for use in cleaning, deodorizing and de-wrinkling garments or clothes items which are preferably not washed using conventional full water immersion wash processes. Past efforts have focused on clothes treating enclosures and apparatus which are designed to clean and refresh garments by employing an air stream, which may be heated, and including other air borne additives such as steam or a conditioning fluid. For example, U.S. Pat. No. 3,752,373 discloses a portable wardrobe refresher utilizing a clothes transporting bag having a rigid frame with flexible wall portions and rigid wall portions forming the enclosure. An arrangement is provided for circulating steam or hot air throughout the enclosure.

U.S. Pat. No. 6,189,346 discloses a clothes treating apparatus in which air is recirculated within the enclosure and over the clothes and a conditioning fluid is dispensed into the air stream.

U.S. Pat. No. 3,869,815 discloses a garment finishing apparatus in which a blower is used to recirculate a flow of air within a cabinet and vent hole is provided in the blower outlet side of the motor to allow a portion, e.g., 10%, of the air entering the blower inlet to exhaust to the atmosphere to facilitate removal of moisture from the cabinet interior. Cracks in the cabinet due to the imperfect sealing of the door with the cabinet opening permit make-up air to enter the cabinet interior to avoid creation of a significant vacuum in the cabinet interior.

SUMMARY OF THE INVENTION

In an embodiment, the present invention provides an expandable and collapsible enclosure for a garment refreshing appliance. The appliance has at least either a top or a bottom rigid housing structure. The enclosure comprises a wall structure extending substantially an entire height of the enclosure. The wall structure is made of a flexible material. An opening is provided in the wall structure through which garments can be introduced into or removed from the enclosure. A zipper is attached at the opening to selectively open and close the opening. A snap attachment mechanism is located at either or both of the top and a bottom of the wall structure for securing the wall structure to the top and/or bottom rigid housing structures.

In an embodiment, the wall structure is formed of a material which is substantially air tight.

In an embodiment, the opening extends along a majority of a height of the wall structure.

In an embodiment, the zipper is constructed to provide a substantially air tight seal for the opening.

In an embodiment, the snap attachment mechanism provides a substantially air tight seal between the wall structure and the top and/or bottom rigid housing structures.

In an embodiment, the snap attachment mechanism is located at both the top and bottom of the wall structure for securing the wall structure to both the top and bottom rigid housing structure.

In an embodiment, the zipper is provided with a position detecting mechanism to detect whether the zipper is in a fully closed position.

In an embodiment, the zipper includes an enlarged pull tab.

In an embodiment, the wall structure includes a passage for receiving and guiding electrical wires along a height of the wall structure.

In an embodiment, the snap attachment mechanism comprises an extruded plastic member.

In an embodiment, at least one of the top and bottom rigid housing structures includes a space sized sufficiently large to receive the wall structure of the enclosure in a collapsed form.

In an embodiment, the zipper is configured to provide a door type component in the wall structure, wherein the door type component can be folded open to expose an interior of the enclosure.

In an embodiment, the door type component is provided with an attachment mechanism with which the door type component can be secured to a portion of the enclosure to retain the door type component in an open position.

In an embodiment, an expandable and collapsible enclosure for a garment refreshing appliance is provided, comprising a wall structure extending substantially an entire height of the enclosure, the wall structure comprising a flexible material. An opening is provided in the wall structure through which garments can be introduced into or removed from the enclosure. A zipper is attached at the opening to selectively open and close the opening.

In an embodiment, a method is provided for operating a clothes refresher device having a refreshing mechanism and an flexible enclosure secured to a top member comprising the steps of expanding the flexible enclosure structure by lifting the top member to a raised position, introducing a garment into an interior of the enclosure structure through an opening in the enclosure structure, closing the opening in the enclosure structure, operating the refreshing mechanism, opening the opening in the enclosure structure, removing the garment from the enclosure, and collapsing the flexible enclosure structure by lowering the top member to a lowered position.

DETAILED DESCRIPTION OF THE PREFERRED EMBODIMENT

Figure 1:
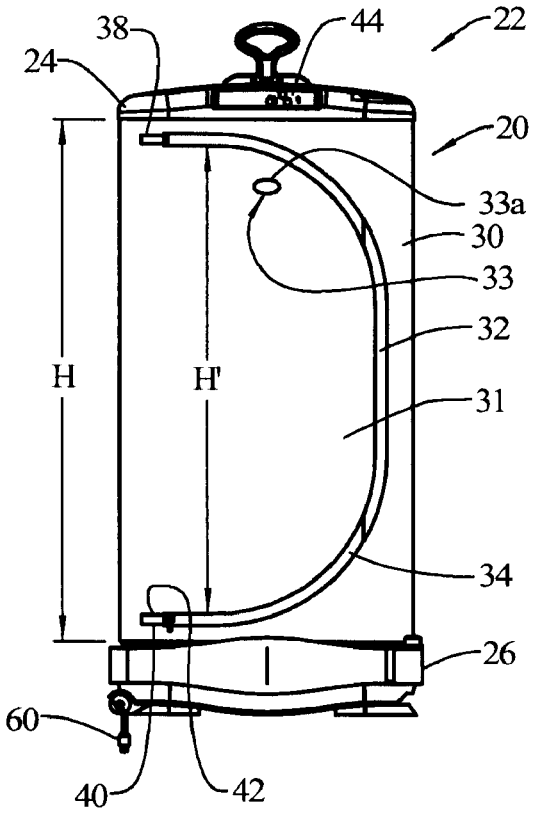
FIG. 1 is a front elevational view of a clothes refreshing appliance with an enclosure in an expanded condition embodying the principles of the present invention.
Figure 2:
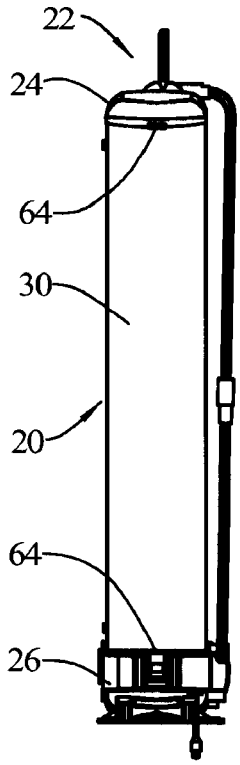
FIG. 2 is a side elevational view of the clothes refreshing appliance of FIG. 1.
Figure 3:
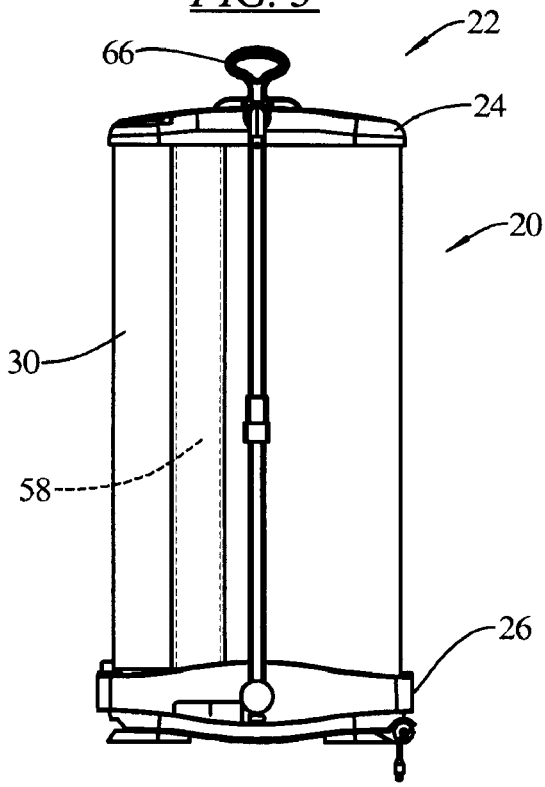
FIG. 3 is a rear elevational view of the clothes refreshing appliance of FIG. 1.
Figure 5:
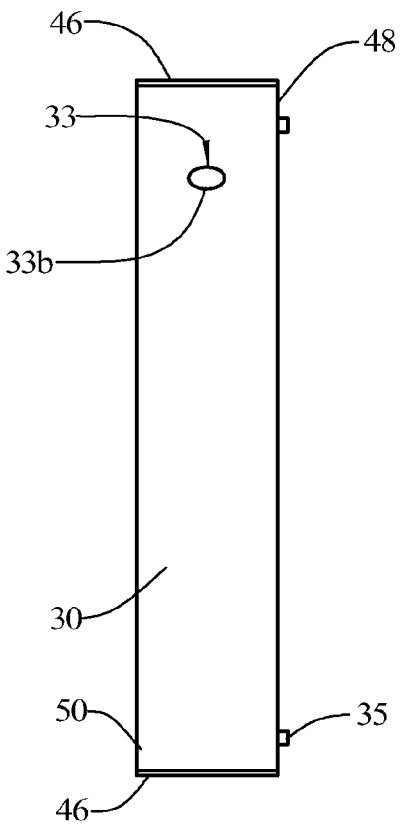
FIG. 5 is a side elevational view of the enclosure of FIG. 4.
Figure 4:
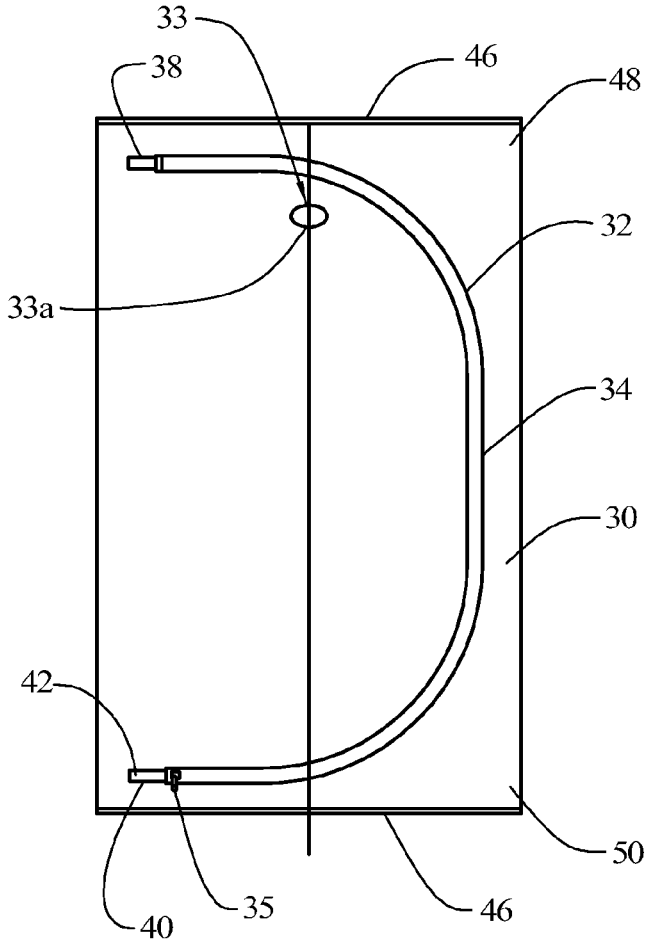
FIG. 4 is a front elevational view of the enclosure embodying the principles of the present invention in isolation.

As illustrated in FIGS. 1-7, the present invention provides an expandable and collapsible enclosure 20 for a garment refreshing appliance 22. The appliance 22 has at least either a top 24 or a bottom 26 rigid housing structure. The enclosure 20 comprises a wall structure 30 extending substantially an entire expanded height H of the enclosure. The height H of the enclosure can vary through a wide range, such as between 2 and 6 feet, however, preferably the height is between 2½ and 5 feet, and may be around 3 feet tall and be able to accommodate nearly all garments without requiring more than a single fold of the garment as it is hanging within the structure, and with most garments hanging without folding. The wall structure 30 is made of a flexible material, for example a nylon polyamide. In some embodiments, the nylon, or other flexible material, may have a coating, such as polyurethane, to improve the imperviousness of the wall structure 30, such as to make the material of the wall structure substantially air or moisture tight. For example, the material may be impermeable to the passage of air molecules up to a pressure differential of 5 atmospheres from the interior to the exterior of the enclosure material. In other embodiments, the impermeability of the wall structure 30 is not critical or necessary, and thus no coating material need be applied to the material of the wall structure.

An opening 32 is provided in the wall structure 30 through which garments can be introduced into or removed from the enclosure 20. Although the opening 32 illustrated is in the form of the curved portion of a capital D shape, other shapes for the opening may be used. Generally, the opening 32 should be large enough to introduce garments without folding them more than they are (if they are at all), and in most embodiments of the invention, the opening has a height H' which is at least one half of the height H of the wall structure.

In embodiments where the opening 32 has a shape generally such as shown, the opening will define a door type component 31 which can be moved to an open position to allow entry of the garment into the interior of the enclosure 20, such as by folding or pivoting along a line defined by the ends of the opening. In such an embodiment, the door type component 31 may be provided with an attachment mechanism 33 with which the door type component can be secured to a portion of the enclosure 20 to retain the door type component in an open position. The attachment mechanism 33, which may be formed in two mating components, would generally have one component 33*a* secured to the door type component 31 and another component 33*b* secured to the wall structure, such that the two components would mate when the door type component is in the open position. Such mating components could be a hook and loop type fastener, a magnetic type fastener, a button and loop type fastener, or any other known type of releasable and resecurable type fastener.

A zipper 34, which may include an easily graspable pull tab 35, is attached at the opening 32 to selectively open and close the opening. The term zipper as used herein is meant to include a variety of openable and reclosable closure mechanisms including a series of interlocking teeth arranged along the length of the opening, an interlocking ridge and groove arrangement, such as in a zip-lock bag, hook and loop fastening strips or discrete and separated pieces, magnetically co-attractive strips or individual elements, and similar openable and reclosable elements, including those operated by means of a movable element which slides along the length of the closure mechanism, or by means of manual manipulation of the user.

In an embodiment, the zipper 34 is constructed to provide a substantially air tight seal for the opening 32. For example, the zipper may have teeth formed of a continuous coil plastic material. In an embodiment, the zipper 34 is provided with a position detecting mechanism 36 to detect whether the zipper is in a fully closed position. For example, the position detecting mechanism 36 may comprise a proximity switch 38, such as a magnetically operated reed switch. In such an embodiment, a magnet 40 may be carried on a body 42 of the zipper 34, and the magnetically operated proximity switch 38 may be provided near a closed end of the opening 32, or vice versa, such that the switch 38 will change states, between open and closed, when the zipper is moved fully to the closed position of the opening. The switch 38 may be connected to a control 44 for the clothes refresher appliance 22 such that operation of the clothes refresher will not be enabled whenever the zipper 34 is not in the fully closed position. This will prevent operation of the clothes refresher 22, which in some operating modes, may include the circulation of gasses, mists or other carriers which contain malodorous or potentially harmful chemicals.

Figure 6:
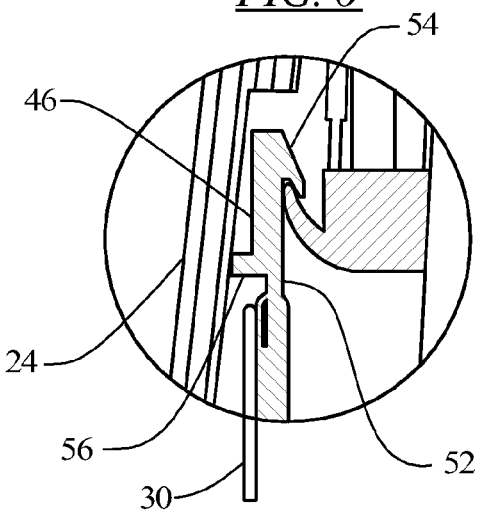
FIG. 6 is an enlarged, partial cross sectional view of the attachment arrangement between the enclosure and the top structure of the appliance.
Figure 7:
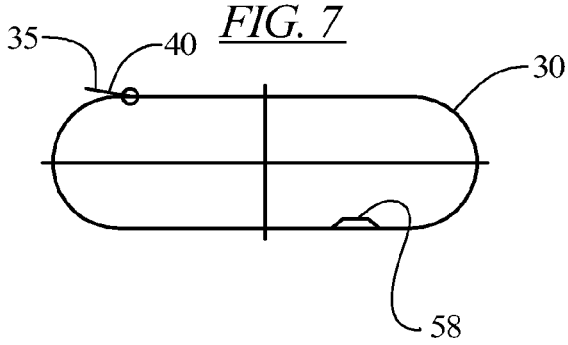
FIG. 7 is a plan view of the enclosure of FIG. 4.
Figure 11:
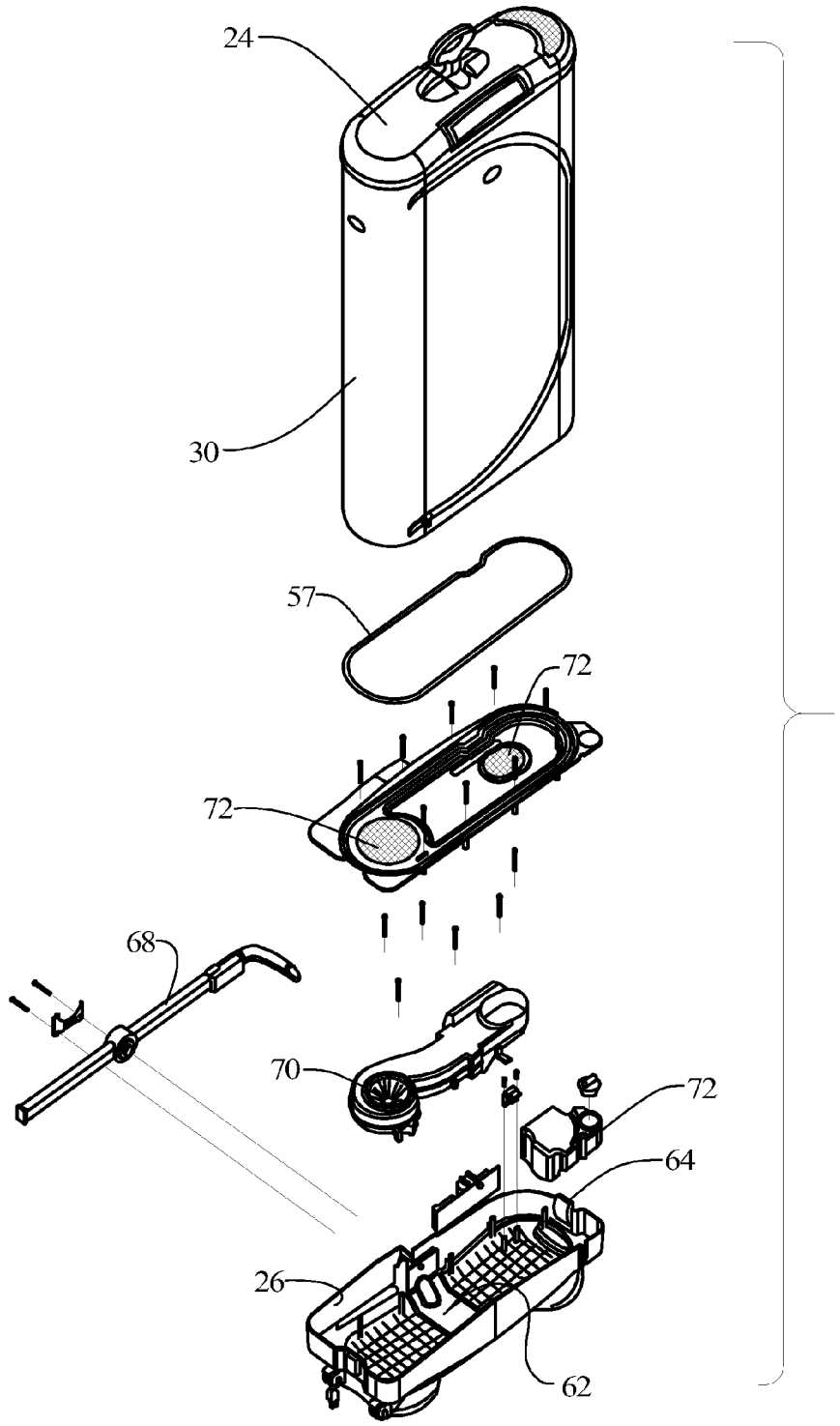
FIG. 11 is an exploded perspective view of the clothes refreshing appliance of FIG. 1.

A snap attachment mechanism 46 is located at either or both of a top 48 and a bottom 50 of the wall structure 30 for securing the wall structure 30 to the top 24 and/or bottom 26 rigid housing structures. As an example, as shown in detail in FIG. 6, the snap attachment mechanism 46 may comprise an extruded an extruded plastic member 52 which is secured to the top 48 and/or the bottom 50 of the wall structure 30, such as by sewing, riveting, gluing, or other known attachment arrangements. The extruded plastic member 52 may be provided with a hook portion 54 to interferingly mate with a flexible locking feature 56 provided on the top 24 and/or bottom 26 rigid housing structures. For example, shown in FIG. 6 is an embodiment where the top rigid housing structure 24 is provided with the flexible locking feature 56 on a locking member 57 to which the hook portion 54 is interferingly mated after the extruded plastic member 52 has been pushed up past the flexible locking feature to provide the locking engagement. In an embodiment, the snap attachment mechanism 46 provides a substantially air tight seal between the wall structure 30 and the top 24 and/or bottom 26 rigid housing structures. The bottom structure 26 may also be provided with such a locking member 57, as shown in FIG. 11. The locking members 57 in either or both of the top 24 and bottom 26 structures are preferably located in a recessed position such that the top 48 and bottom 50 of the wall structure 30 is hidden from view once the wall structure is attached to either or both of the top and bottom structures.

In an embodiment, the wall structure 30 includes a passage 58 isolated from an interior 59 of the enclosure structure where garments are placed for receiving and guiding electrical wires along the height H of the wall structure 30. The passage 58 may be formed by having an additional length of flexible wall material attached, such as by sewing, gluing, heat welding, etc., to the wall structure 30. This passage will accommodate wires which extend between the top 24 and bottom 26 rigid housing structures, particularly where an electrical power connector 60 is provided at the bottom structure 26 and the control 44 is located in the top structure 24.

Figure 8:
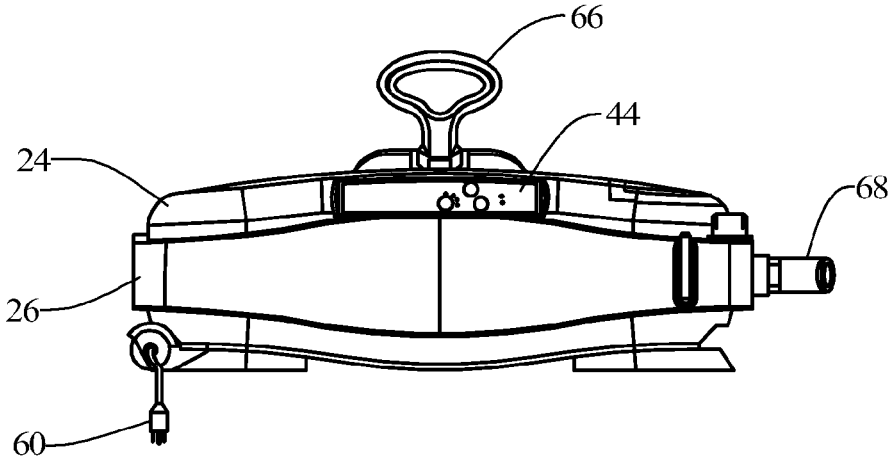
FIG. 8 is a front elevational view of the clothes refreshing appliance of FIG. 1 in a collapsed condition of the enclosure.
Figure 10:
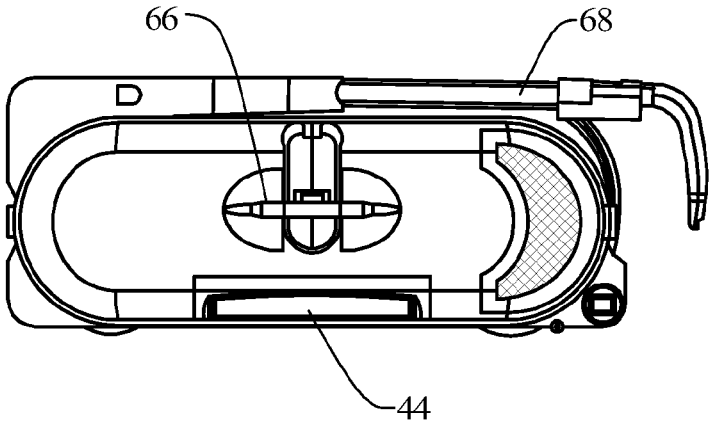
FIG. 10 is a plan view of the clothes refreshing appliance of FIG. 1 in a collapsed condition of the enclosure.
Figure 9:
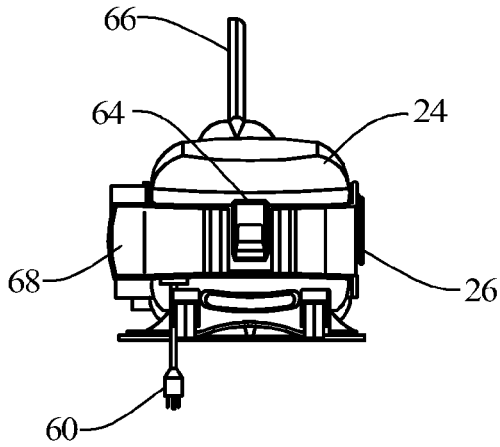
FIG. 9 is a side elevational view of the clothes refreshing appliance of FIG. 1 in a collapsed condition of the enclosure.

In an embodiment, at least one of the top 24 and bottom 26 rigid housing structures includes a space 62 (FIG. 11) sized sufficiently large to receive the wall structure 30 of the enclosure 20 in a collapsed form. This allows the entire wall structure 30 to be collapsed into either or both of the top 24 and/or bottom 26 rigid housing structures, such as shown in FIGS. 8-10. In such an embodiment, the refresher appliance 22 may be stored and/or transported in a compact form between uses. The top 24 and bottom 26 housing structures may be provided with one or more mating latching structures 64 to secure the tip and bottom structures together when the refresher appliance 22 is in the collapsed condition. A manually graspable handle 66 may be provided on the top structure 24 to assist in the expansion of the refresher appliance 22 and its wall structure 30 when the appliance is being transformed into the expanded condition.

A pivotable and telescopically expandable frame element 68 may be provided on the bottom structure 26 which can be moved into position and extended into a supporting height to engage with the top structure 24 to hold the wall structure 30 in its expanded condition to permit use of the appliance. Other arrangements of frame elements 68 may be utilized, such as fixed length, folding or stacking elements, and the frame elements may be attached differently, such as by snap connections, interference connections, permanent connections, etc. to one or the other, or both of the top 24 and bottom 26 structures. Also, more than one frame element 68 may be used with the appliance 22.

The clothes refresher appliance 22 is also provided with other conventional elements such as a motor driven air moving device 70, a reservoir 72 for holding a fluid to be dispensed within the enclosure 30, and various filters and air flow directors 72 in a conventional manner as components of a refreshing mechanism. The control 44 is used to operate the clothes refresher appliance 22 in a clothes refreshing cycle and to control various components of the appliance such as the air moving device 70 and any controlled dispensers that may be provided in the appliance. The position detecting mechanism 38 may be used to disable the control 44, and other similar devices may be provided, such as in connection with the frame element 68 to assure that the wall structure 30 is in its expanded condition before the control 44 is enabled.

In an embodiment of the invention, a method is provided for operating a clothes refresher appliance 22 having a refreshing mechanism and an flexible enclosure 30 secured to a top member 24 comprising the steps of expanding the flexible enclosure structure by lifting the top member to a raised position, introducing a garment into the interior 59 of the enclosure structure through an opening 34 in the enclosure structure, closing the opening in the enclosure structure, operating the refreshing mechanism, opening the opening in the enclosure structure, removing the garment from the enclosure, and collapsing the flexible enclosure structure by lowering the top member to a lowered position.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. An expandable and collapsible enclosure for a garment treating appliance, comprising one of a top and a bottom rigid housing structure:

a wall structure extending substantially an entire height of said enclosure, said wall structure comprising a flexible material, an opening in said wall structure through which garments can be introduced into or removed from an interior of said enclosure, a zipper attached at said opening to selectively open and close said opening, and a snap attachment mechanism located at least one of a top and a bottom of said wall structure for securing said wall structure to at least one of said top and bottom rigid housing structure, the snap attachment mechanism comprising a hook member formed on an extruded plastic member that is secured around a periphery of one of a top and a bottom of the wall structure, the corresponding top or bottom rigid structure being provided with a locking member extending around a periphery of the top or bottom rigid structure having a flexible locking feature for interferingly mating with the hook member to provide a locking engagement therebetween while the wall structure is in an expanded condition.

2. An enclosure according to claim 1, wherein said wall structure is formed of a material which is substantially air tight.

3. An enclosure according to claim 1, wherein said opening extends along a majority of a height of said wall structure.

4. An enclosure according to claim 1, wherein said zipper is constructed to provide a substantially air tight seal for said opening.

5. An enclosure according to claim 1, wherein said snap attachment mechanism provides a substantially air tight seal between said wall structure and said at least one of said top and bottom rigid housing structure.

6. An enclosure according to claim 1, wherein said snap attachment mechanism is located at both the top and bottom of said wall structure for securing said wall structure to both said top and bottom rigid housing structures.

7. An enclosure according to claim 1, wherein said zipper is provided with a position detecting mechanism to detect whether said zipper is in a fully closed position.

8. An enclosure according to claim 1, wherein said zipper includes an enlarged pull tab.

9. An enclosure according to claim 1, wherein at least one of said top and bottom rigid housing structures includes a space sized sufficiently large to receive said wall structure of said enclosure in a collapsed form.

10. An enclosure according to claim 1, wherein said zipper is configured to provide a door type component in said wall structure, wherein said door type component can be folded open to expose an interior of said enclosure.

11. An enclosure according to claim 10, wherein said door type component is provided with an attachment mechanism with which said door type component can be secured to a portion of said enclosure to retain said door type component in an open position.

12. An expandable and collapsible enclosure for a garment treating appliance, comprising one of a top and a bottom rigid housing structure:

a wall structure extending substantially an entire height of said enclosure, said wall structure comprising a flexible material, an opening in said wall structure through which garments can be introduced into or removed from an interior of said enclosure, a zipper attached at said opening to selectively open and close said opening, and a snap attachment mechanism located at least one of a top and a bottom of said wall structure for securing said wall structure to at least one of said top and bottom rigid housing structure, the snap attachment mechanism comprising a hook member secured to one of a top and a bottom of the wall structure, the corresponding top or bottom rigid structure being provided with a flexible locking feature for interferingly mating with the hook member to provide a locking engagement therebetween while the wall structure is in an expanded condition, wherein said wall structure includes a passage isolated from said interior of said enclosure for receiving and guiding electrical wires along substantially an entire height of said wall structure.

13. An expandable and collapsible enclosure for a garment treating appliance, comprising:

a housing structure including top and bottom rigid housing structures, a wall structure extending substantially an entire height of said enclosure between said top and bottom rigid housing structures, said wall structure comprising a flexible material and defining an interior of said enclosure for receiving garments, the wall structure including a single passage isolated by a flexible wall structure from said interior of said enclosure extending along substantially a full height of the wall structure for receiving and guiding a plurality of electrical wires within said single passage along the height of said wall structure from said bottom rigid housing structure to said top rigid housing structure, an opening in said wall structure through which garments can be introduced into or removed from said enclosure, and a zipper attached at said opening to selectively open and close said opening.

14. An enclosure according to claim 13, wherein said wall structure is formed of a material which is substantially air tight.

15. An enclosure according to claim 13, wherein said opening extends along a majority of the height of said wall structure.

16. An enclosure according to claim 13, wherein said zipper is constructed to provide a substantially air tight seal for said opening.

17. An enclosure according to claim 13, wherein said zipper is provided with a position detecting mechanism to detect whether said zipper is in a fully closed position.

18. An enclosure according to claim 13, wherein said zipper includes an enlarged pull tab.

19. An enclosure according to claim 13, wherein said zipper is configured to provide a door type component in said wall structure, wherein said door type component can be folded open to expose an interior of said enclosure.

20. An enclosure according to claim 19, wherein said door type component is provided with an attachment mechanism with which said door type component can be secured to a portion of said enclosure to retain said door type component in an open position.

21. An expandable and collapsible enclosure for a garment treating appliance, comprising one of a top and a bottom rigid housing structure:

a wall structure extending substantially an entire height of said enclosure, said wall structure comprising a flexible material, an opening in said wall structure through which garments can be introduced into or removed from said enclosure, a zipper attached at said opening to selectively open and close said opening, and a pair of locking members comprising extruded plastic members, each having a length which extends substantially around a circumference of said flexible material wall structure, each having a hook portion, and each being secured to one of a top end and a bottom end of said flexible material wall structure, to engage said wall structure and lock said wall structure to a flexible locking feature located on the top rigid housing structure and the bottom rigid housing structure, respectively, to provide a substantially air tight seal between the wall structure and the top and bottom rigid housing structures while said enclosure is in an expanded position with said top rigid housing structure spaced away from said bottom rigid housing structure.

* * * * *

UNITED STATES PATENT AND TRADEMARK OFFICE

CERTIFICATE OF CORRECTION

PATENT NO. : 8,141,269 B2
APPLICATION NO. : 10/852758
DATED : March 27, 2012
INVENTOR(S) : George F. Seiffert et al.

It is certified that error appears in the above-identified patent and that said Letters Patent is hereby corrected as shown below:

Col. 8, lines 12 - 35, Claim 21: "An expandable and collapsible enclosure for a garment treating appliance, comprising one of a top and a bottom rigid housing structure: a wall structure extending substantially an entire height of said enclosure, said wall structure comprising a flexible material, an opening in said wall structure through which garments can be introduced into or removed from said enclosure, a zipper attached at said opening to selectively open and close said opening, and a pair of locking members comprising extruded plastic members, each having a length which extends substantially around a circumference of said flexible material wall structure, each having a hook portion, and each being secured to one of a top end and a bottom end of said flexible material wall structure, to engage said wall structure and lock said wall structure to a flexible locking feature located on the top rigid housing structure and the bottom rigid housing structure, respectively, to provide a substantially air tight seal between the wall structure and the top and bottom rigid housing structures while said enclosure is in an expanded position with said top rigid housing structure spaced away from said bottom rigid housing structure." - should be Claim 21: --An expandable and collapsible enclosure for a garment treating appliance, comprising one of a top and a bottom rigid housing structure, a wall structure extending substantially an entire height of said enclosure, said wall structure comprising a flexible material, an opening in said wall structure through which garments can be introduced into or removed from said enclosure, a zipper attached at said opening to selectively open and close said opening, and a pair of locking members comprising extruded plastic members, each having a length which extends substantially around a circumference of said flexible material wall structure, each having a hook portion, and each being secured to one of a top end and a bottom end of said flexible material wall structure, to engage said wall structure and lock said wall structure to a flexible locking feature located on the top rigid housing structure and the bottom rigid housing structure, respectively, to provide a substantially air tight seal between the wall structure and the top and bottom rigid housing structures while said enclosure is in an expanded position with said top rigid housing structure spaced away from said bottom rigid housing structure.--

Signed and Sealed this
Twenty-first Day of August, 2012

David J. Kappos

David J. Kappos
*Director of the United States Patent and Trademark Office*